US009775392B2

(12) United States Patent
Peterson et al.

(10) Patent No.: US 9,775,392 B2
(45) Date of Patent: Oct. 3, 2017

(54) INNERWEAR POCKET SYSTEM AND METHOD

(71) Applicant: POCKET INNERWEAR, INC., West Jordan, UT (US)

(72) Inventors: Nicholle Peterson, Idaho Falls, ID (US); Katie McGee Larsen, Idaho Falls, ID (US); Laurel Kay Bloomfield, Waitsburg, WA (US)

(73) Assignee: POCKET INNERWEAR, INC., West Jordan, UT (US)

( * ) Notice: Subject to any disclaimer, the term of this patent is extended or adjusted under 35 U.S.C. 154(b) by 0 days.

(21) Appl. No.: 14/871,697

(22) Filed: Sep. 30, 2015

(65) Prior Publication Data

US 2016/0095372 A1 Apr. 7, 2016

Related U.S. Application Data

(60) Provisional application No. 62/071,813, filed on Oct. 4, 2014, provisional application No. 62/122,438, filed on Oct. 20, 2014.

(51) Int. Cl.
*A41D 27/20* (2006.01)

(52) U.S. Cl.
CPC ..... *A41D 27/205* (2013.01); *A41D 27/201* (2013.01); *A41D 27/204* (2013.01)

(58) Field of Classification Search
CPC .... A41D 27/20; A41D 27/201–27/202; A41D 27/204–27/205
USPC ..... 2/247–248
See application file for complete search history.

(56) References Cited

U.S. PATENT DOCUMENTS 204,723 A * 6/1878 Greenebaum ..... A41D 27/20 2/248
1,355,044 A * 10/1920 Hjelm ..... A41D 27/20 2/252
1,563,251 A * 11/1925 Chernoff ..... A41D 27/201 2/252
1,618,418 A * 2/1927 Fields ..... A41D 27/20 2/253
1,780,204 A * 11/1930 Mastin ..... A41D 27/20 2/253

(Continued)

FOREIGN PATENT DOCUMENTS

CN 204273343 4/2015
JP 3130065 U 3/2007

*Primary Examiner* — Clinton T Ostrup
*Assistant Examiner* — Bao-Thieu L Nguyen
(74) *Attorney, Agent, or Firm* — Pate Baird, PLLC

(57) ABSTRACT

An innerwear system combines a form fitting article of clothing, worn as a layer, typically below a presentation layer of street clothing or conventional clothing. The innerwear article of clothing is provided with a pocket having two opposing and overlapping pockets as the containment portion and cover portion, respectively. The smaller (inverted, cover) pocket overlaps the upper portion of the lower (upright, main) pocket or containment portion. Fingers of a user may reach under the cover, engage the edge of the containment, and open a "mouth" to insert securely an object such as a phone, insulin pump system, personal article, or the like. A stabilized access port out through the cover or inward through the clothing article may pass a line from the contained object.

9 Claims, 13 Drawing Sheets

(56) References Cited

U.S. PATENT DOCUMENTS 1,820,572 A * 8/1931 Ling ..... A41D 27/201 2/252
2,077,153 A * 4/1937 Lipshie ..... A41D 27/20 2/247
2,087,123 A * 7/1937 Serak ..... A41D 27/20 2/253
2,129,196 A * 9/1938 Boshnack ..... A41D 27/20 2/254
2,211,550 A * 8/1940 Tworoger ..... A41D 27/20 2/253
2,381,580 A * 8/1945 Einbinder ..... A41D 27/20 2/247
2,383,746 A * 8/1945 Shapiro ..... A41D 27/20 2/247
2,486,584 A * 11/1949 Yagodnik ..... A41D 27/20 2/253
2,501,162 A * 3/1950 De Grazia ..... A41D 27/20 2/251
2,840,824 A * 7/1958 Horner ..... A41D 27/20 2/247
2,930,046 A * 3/1960 Sagner ..... A41D 27/20 2/227
2,988,750 A * 6/1961 Reed ..... A41D 27/20 2/248
3,077,604 A * 2/1963 Colangelo ..... A41D 27/20 2/253
3,091,773 A * 6/1963 Andrews ..... A41D 27/20 2/247
3,370,370 A * 2/1968 Lippman ..... G09F 21/02 2/247
4,303,187 A 12/1981 Berman
4,464,798 A * 8/1984 Livingstone ..... A41D 27/20 2/247
4,625,337 A * 12/1986 Zahn ..... G09F 3/00 2/247
4,831,666 A * 5/1989 Denman ..... A41D 13/065 2/23
4,958,386 A 9/1990 Louis-Jeune
5,048,125 A 9/1991 Libertini et al.
5,165,115 A 11/1992 Stanislaw
5,172,430 A 12/1992 Lerma-Solis
5,255,392 A 10/1993 Stanislaw
5,630,232 A * 5/1997 Miller ..... A41B 9/02 2/234
5,826,273 A * 10/1998 Eckes ..... A41D 13/0058 2/115
6,550,471 B2 4/2003 Szymocha et al.
6,691,323 B2 * 2/2004 Widmer ..... A41D 27/20 2/247
7,032,249 B2 4/2006 Smith
7,364,491 B2 * 4/2008 Updyke ..... A41C 3/0035 2/247
7,681,255 B2 * 3/2010 Morales ..... A41D 1/06 2/247
D619,334 S * 7/2010 Barina ..... D2/857
7,942,856 B2 * 5/2011 Lentini ..... A41D 13/1245 2/100
8,156,572 B2 4/2012 Whaley
8,302,212 B1 11/2012 Wiens
8,321,964 B2 12/2012 Gernes
8,411,891 B2 4/2013 Del Prete
8,566,963 B2 10/2013 Ryan
8,776,268 B2 * 7/2014 Rodgers ..... A41D 19/002 2/158
9,044,053 B1 * 6/2015 Osatchuck ..... A41D 13/0575
9,060,550 B2 6/2015 Conrad
9,149,073 B1 * 10/2015 Hirshberg ..... A41B 5/00
2002/0100108 A1 * 8/2002 Stuart ..... A41D 13/0015 2/247
2002/0157170 A1 * 10/2002 Lipscher ..... A41D 27/205 2/250
2005/0145657 A1 7/2005 Norberg
2005/0246823 A1 * 11/2005 Groom ..... A41D 27/205 2/247
2006/0206990 A1 * 9/2006 Demus ..... A41D 27/205 2/247
2007/0124846 A1 * 6/2007 Mosley ..... A41D 25/00 2/144
2009/0094725 A1 * 4/2009 Smith ..... A41D 27/205 2/69
2011/0217219 A1 * 9/2011 Menzel ..... B01D 53/1456 423/228
2011/0219510 A1 * 9/2011 Nuzzo ..... A41D 13/0575 2/16
2011/0225700 A1 9/2011 Kogut
2011/0277219 A1 11/2011 Demus
2012/0158074 A1 6/2012 Hall
2012/0291179 A1 * 11/2012 Shea ..... A41D 1/04 2/102
2013/0239298 A1 * 9/2013 Jordan ..... A41D 27/20 2/250
2015/0003656 A1 * 1/2015 Pardo ..... A41D 7/005 381/334
2015/0282535 A1 * 10/2015 Rowe ..... A41D 1/067 2/237
2016/0143424 A1 * 5/2016 Stephens ..... A45F 3/005 224/222
2016/0270464 A1 * 9/2016 Nigri ..... A41D 23/00

* cited by examiner

INNERWEAR POCKET SYSTEM AND METHOD

RELATED APPLICATIONS

This application claims the benefit of U.S. Provisional Patent Application Ser. No. 62/071,813, filed Oct. 4, 2014 for POCKET INNERWEAR; A SYSTEM AND METHOD FOR INSTALLING STORAGE SYSTEMS IN UNDERGARMENTS AND CLOTHING, and U.S. Provisional Patent Application Ser. No. 62/122,438, filed Oct. 20, 2014 for POCKET INNERWEAR; A SYSTEM AND METHOD FOR INSTALLING STORAGE SYSTEMS IN UNDERGARMENTS AND CLOTHING; A MEDICAL DEVICE ON PERSON STORAGE SYSTEM, both of which are hereby incorporated herein by reference in their entirety.

BACKGROUND

1. Field of the Invention

This invention relates to clothing and, more particularly, to novel systems and methods for creating specialized pockets therefor.

2. Background Art

Clothing is presumptively a part of modern culture. Having existed for millennia, articles of clothing originally began as robes, togas, and other articles ranging from undergarments to outer garments, and on to weatherproof outerwear.

As a practical matter, pockets were not a part of clothing even as recently as the $19^{th}$ century. Eventually, clothing came to include pockets. Thereafter, pockets were introduced as permanent parts of regular clothing.

Open pockets are common. These include pockets having an opening accessible without opening any closure. Likewise, pockets having closures exist and have existed for many years. Closures may include buttons, hook-and-loop fasteners, snaps, zippers, and the like. Typically, such closure mechanisms are secured to operate between a covering flap or the article of clothing itself, and an outer surface of a pocket itself.

Pockets are a convenience. They can sometimes be an inconvenience. Pockets in articles of clothing are necessarily and most typically general purpose pockets to fit or receive a variety of items. Depending on convenience, structure of the article of clothing, and so forth, a closure may or may not be included.

Often, a closure is not included, such as in a breast pocket of a dress shirt in men's clothing, an inside breast pocket in a sports coat, suit, dinner jacket, or other open shirt pocket. An inherent presumption for these is that the pocket will not be turned upside down.

Work clothes, active wear, or clothing for athletic and other active endeavors may be more likely to include some type of covering (a flap or tab), having a closure mechanism to maintain it in a closed position and permit release for access to the pocket.

Outer clothing or the presentation clothing that is typically seen by others than the wearer typically is comparatively loose fitting. Looseness itself presents certain problems in securing articles in pockets. Underwear, sports inner layers, exercise and yoga outfits, dance wear, and other innerwear may be form fitting or may also be loose.

It would be an advance in the art to provide a new article of clothing, a new type of pocket, and a combination of both to provide more secure containment of articles within a pocket of innerwear on active users.

It would be an advance in the art to provide certain improvements in closure systems. It would also be an advance in the art to provide easy access and re-closure with a single hand and no alignment or force. It would be an advance to provide to articles in a secure pocket for devices such as music play devices, mobile phones, insulin pumps, and the like.

For example, type I diabetics, those acquiring the disease while juveniles, may rely on an insulin pump rather than periodic injections. An insulin pump has mass, has three dimensions of space that it occupies, and does not readily fit any current pocket system. Moreover, an infusion site will typically include a catheter for receiving a needle or probe from an insulin pump. Moreover, tubing extends between the infusion site and an insulin pump itself. Managing that pump, preventing kinks in it, concealing the tubing, managing it against being caught, cut, crimped, or the like is problematic. Meanwhile, reducing the length of the tube from a standard system is problematic, as it restricts movement.

Thus, it would be an advance in the art to provide a pocket that is convenient, lightweight, secured firmly against the body of a user at a location that is not exposed to bumping, damage, or the like, and provides concealment yet easy access. A simple, smooth, unobtrusive pocket would be a substantial advance in the art.

As another example, mobile telephones are ubiquitous. It would be an advance in the art to provide a system that is secure, yet easily accessible. In fact, it would be an advance in the art to provide a closure mechanism that does not require great attention, multiple hands, alignments, substantial force, tiny hands, or the like.

BRIEF SUMMARY OF THE INVENTION

In view of the foregoing, in accordance with the invention as embodied and broadly described herein, a method and apparatus are disclosed in one embodiment of the present invention as including a pocket operating as a storage compartment having a unique cover and closing mechanism for the cover. This storage compartment or pocket may be stretchable, elastically to receive and retain a small item such as a mobile phone, debit card, personal electronics item, personal protection tool (e.g., spray, edged weapon, firearm), insulin pump, other medical device, or the like.

It may be made of a larger size and placed in a location whereby it may be accessible for its purpose. For example, a flask, small book, tablet, an electronic tablet, or other personal effects may be secured therein. Likewise, in certain embodiments, a pocket in accordance with the invention may be smaller, specially sized, configured, and constructed to accommodate an insulin pump system.

The cover is designed to secure any item placed therein, even in a fully upside down wearer position. Likewise, the cover is secured against jarring or quick changes of direction, such as may occur during athletic activities, including any number of games, climbing, running, work, and so forth.

A feature of selected embodiments of an apparatus, system, and method in accordance with the invention may include a port or aperture, properly reinforced and stabilized as required or needed, for passing a line from the contained object within the pocket to a location outside the pocket.

For example, a cover may include an aperture passing the cord (line) of a headset or earbuds from a contained MP3 or other audio player, mobile phone, iPod, or the like outside the pocket to the head and ears of a user.

In another example, a pocket may include an interior aperture passing inward through the article of clothing to which the pocket is attached. This aperture may pass a line, such as an insulin tubing line, from an insulin pump contained within the pocket inward (or inside the apparel, considering that this is clothing) in order to reach an infusion site, typically on the abdomen of a user.

In one embodiment, a pocket in accordance with the invention may include a containment portion that represents and functions somewhat like a conventional pocket.

Above and covering the containment portion is the cover portion. In such an embodiment, the containment portion is partially covered by the cover portion. This does not mean that the cover portion is simply a flap. A cover portion may be called a flap, but does not flap and cannot flap. Rather, the cover portion encloses and overlaps the upper edge of the containment portion.

Moreover, the cover portion is fully seamed along (near) its left and right edges. Thus, an upper region and edge of the containment portion is overlapped by a lower portion and edge of the cover or cover portion. The cover portion is a pocket over a pocket, fully seamed on three sides or edges, along its left and right sides, as well as its top edges.

The storage or containment portion is also seamed on three sides or edges, along its left and right edges and along its bottom edge. Thus, in one embodiment, a pocket in accordance with the invention actually includes two traditional pockets, one right side up and one upside down. The one upside down overlaps the upper portion and edge of the one that is right side up.

One may ask how such a pocket opens. The pocket opens by displacement and distortion of one or both of the containment portion and the cover portion.

For example, the bottom edge of the top portion or cover portion may be thought of as a lip, an upper lip of the mouth. Meanwhile, the upper edge of the containment portion or the lower portion may be considered a lower lip. The pocket is opened by reaching a member such as a digit of the hand inside under the cover portion, engaging the lower lip on the containment portion, and spreading the upper lip and lower lip apart.

This necessarily involves distortion of the cover portion and containment portion. This may stretch the fabric of the cover, the containment, the base garment, or all three. It may instead (or also) draw their left and right sides closer together. However, the resulting open mouth then provides a sufficiently large opening to insert any object sized to be contained therein.

Once an object to be contained is fully within the containment portion as far as it will go, the cover portion may be drawn over it if necessary. The natural movement of the underlying fabric of the article of clothing returns to a form fitting position on the user. This return to form fitting returns the containment portion to a location underneath the cover portion. The side seams of each draw the containment portion and cover portion automatically into proper alignment.

No amount of movement can dislodge the contained object from the pocket. This is in large part because the pocket in accordance with the invention is not one but two pockets in the conventional sense. The pocket of the invention may be thought of as two conventional pockets inverted and overlapping one another.

Depending on the application of the pocket in accordance with the invention, one ore more apertures may be formed. For passing a line out from the contained object to the environment outside (or inside) the article of clothing, an aperture may be formed. It may be augmented by one or more stabilization mechanisms, such as a binding seam, satin stitch, reinforcement, grommet, or the like. It may be sized to permit passage of a cord, plug or both to an audio jack, as known in the art, to plug into the contained object.

By the same token, a system that contains an insulin pump, a hearing aid, another medical device, monitor of some type, or the like may rely on an aperture formed between the pocket and the inside of the article of clothing on which the pocket is sewn. Thus, the garment receives an aperture, properly stabilized by binding, reinforcement or other technique in order to durably pass a line from the object or device inside the containment portion. The line exits the pocket through the wall or fabric of the clothing article to be disposed as required.

For example, in the case of an insulin pump, the line is a tube passing inward through clothing from an insulin pump as the object in a containment portion of the pocket. Passing to an infusion site, the line may terminate in a needle to be received inside a catheter installed to administer insulin to the wearer.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 1:
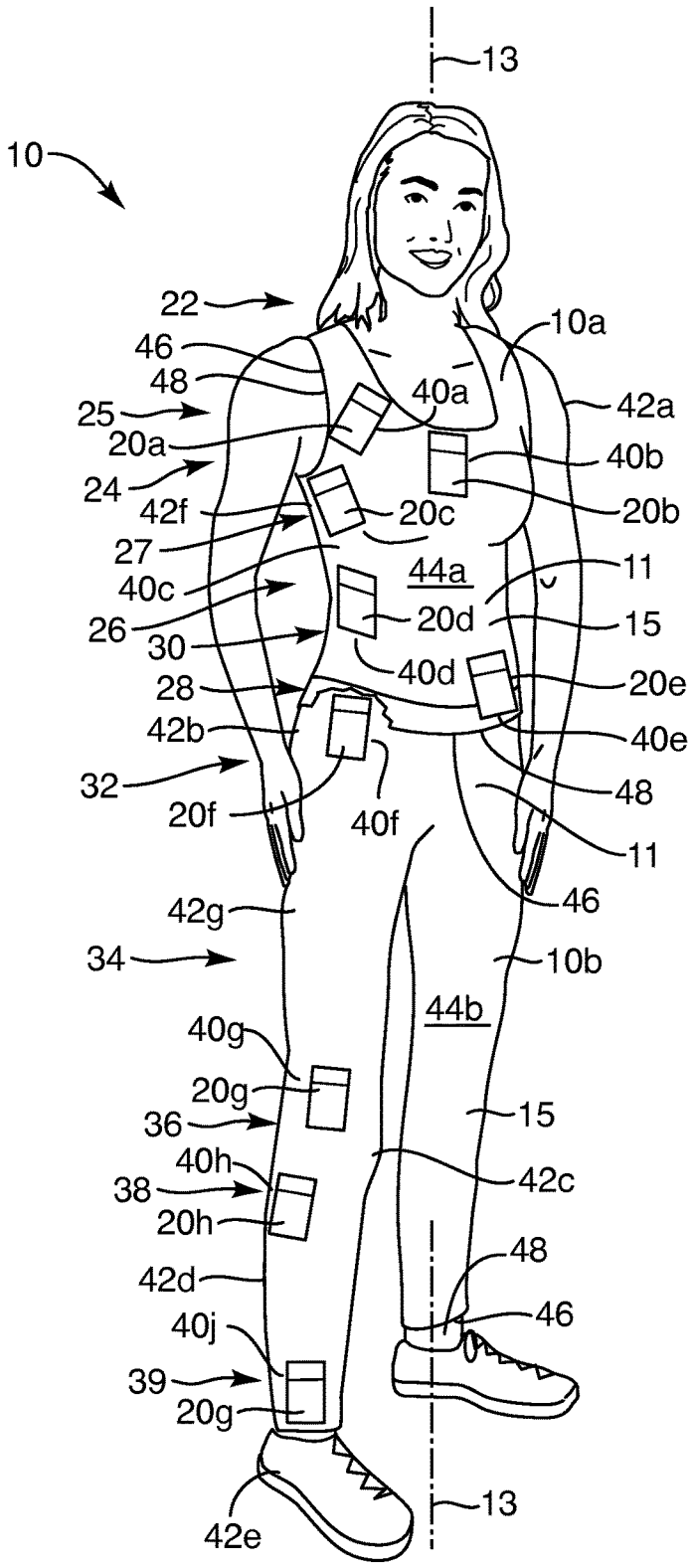
FIG. 1 is a front perspective view of a system in accordance with the invention illustrating various optional locations for positioning a pocket system in accordance with the invention in an article of clothing (e.g., innerwear) on a user.
Figure 2:
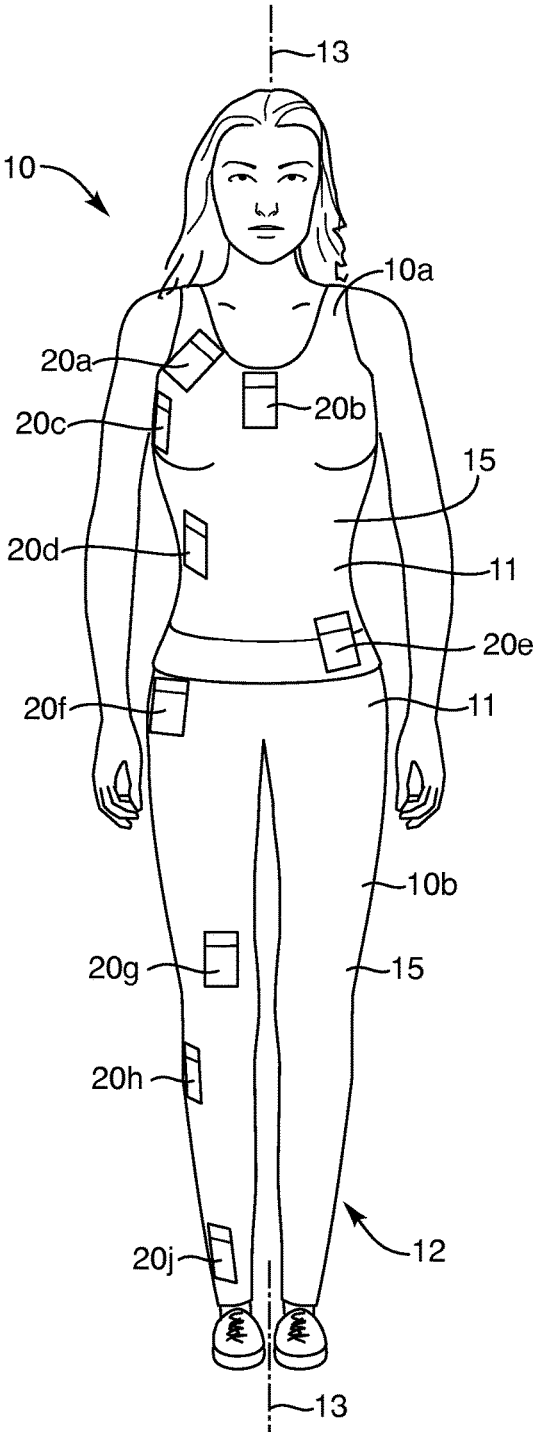
FIG. 2 is a front elevation view of a user wearing a system of innerwear containing pockets in the various optional locations in accordance with invention.
Figure 3:
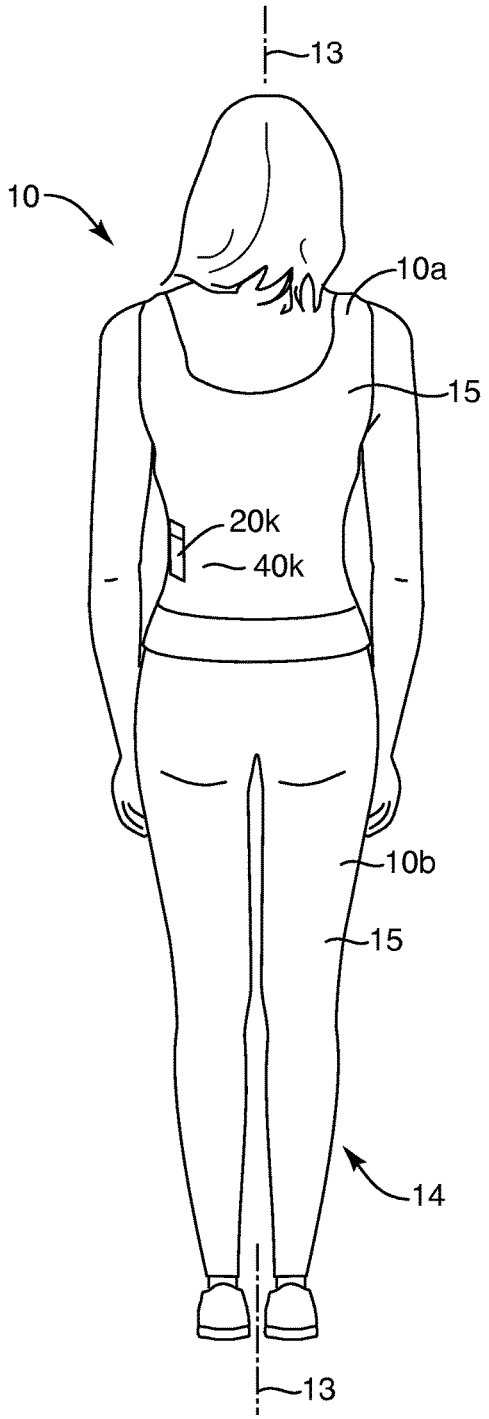
FIG. 3 is a rear elevation view thereof.
Figure 4:
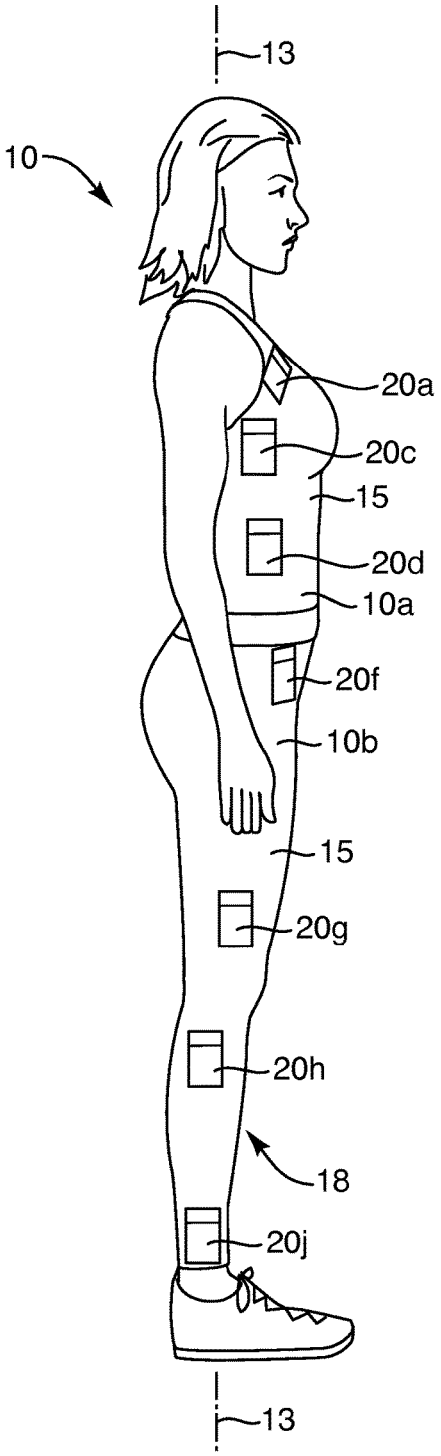
FIG. 4 is a right side elevation view thereof.
Figure 5:
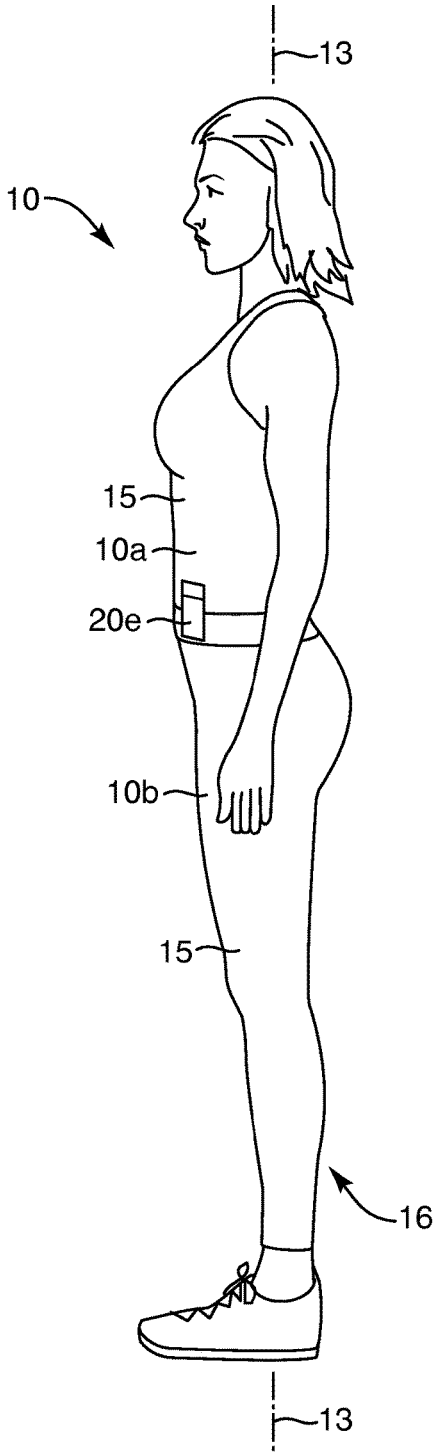
FIG. 5 is a left side elevation view thereof.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Referring to FIGS. 1 through 5, while referring generally to FIGS. 1 through 13, a system 10 in accordance with the invention may include various articles 10*a*, 10*b* of innerwear 10. Herein, whenever a reference numeral is used, it refers to the item identified thereby. Use of a trailing letter after a reference numeral refers to a specific instance of such an item as is indicated by the reference numeral. Thus, it is not necessary to define every instance, and one may speak of all instances by referring only to the numeral.

Thus, a system 10 of innerwear 10 may include a top article 10*a*, a bottom article 10*b*, or both, 10*a*, 10*b*. Typically, a surface 11 or outer surface 11 of such an article 10 will contain or exhibit some choice of color. As a practical matter, innerwear 10 may include sports wear, exercise clothing, athletic apparel, yoga or dance wear, biking shorts, underwear, or the like. Thus, a typical consideration and characterization of innerwear 10 in accordance with the system 10 is a form fitting garment whose outer surface 11 effectively tracks the surface of the skin of a user therebelow, against, or behind.

As a practical matter, innerwear 10 may include an article of under clothing, or sports or athletic clothing that is used in gym or an athletic or recreational activity. Thus, although the expression "innerwear" 10 is used, in some situations, a wearer may actually treat the innerwear 10 as an outer layer of clothing. Nevertheless, in many situations, innerwear 10 may be covered with another outer layer of clothing that may be referred to as street clothing, or the like.

A system 10 in accordance with the invention benefits from the form fitting nature of innerwear 10, and may rely on that feature to provide securement, prevention of escape, and ready maintenance of momentum of a contained article near and with the body of a user.

Referring to FIGS. 2 through 5, while continuing to refer generally to FIGS. 1 through 13, a system 10 of innerwear 10 may be presented with a frontal region 12 or frontal aspect 12. A standing user or upright user may define an axis 13 running nominally vertically through the center of a user. Likewise, the article 10 may include a rear region 14 or rear aspect 14 covering the back surface of a user.

In general, the fabric 15 of which the innerwear 10 is manufactured is typically formed of a fiber, whether natural or synthetic, having woven into it, or as an integral part of it, an elastomeric fiber. It is typically a knit fabric. Thus, the fabric 15, when worn, is typically under tension along its surface 11. This tension provides a certain amount of force.

Tension is defined as a stress, which in engineering parlance is a unit of force per unit of area across which the force acts. Thus, a tensile force or tension force acting on a cross sectional area of a material, such as the fabric 15 may be defined as a tensile stress.

Typically, the left side aspect 16 and the right side aspect 18 or regions 16, 18 are not entirely unique, compared to the frontal 12 and rear 14 aspects. Rather, the curvature of the human body provides an arcuate shape in which the different aspects 12, 14, 16, 18 viewed are not mutually exclusive areas.

Referring to FIGS. 1 through 5, and FIGS. 1 through 13 generally, a system 10 may include a pocket 20. A pocket 20 may be placed in any of several available locations. For example, the innerwear 10 may include a neck region 22 near a neck of a user. An arm region 24 may include simply an arm hole or may include a sleeve. Meanwhile, a shoulder region 25 may simplify to a narrow strap, or may include a larger panel covering a shoulder of a user, and extending to connect to a sleeve.

Likewise, a torso region 26 may include the region from the shoulders and arms of a user down toward a hip region 32. In fact, a torso region 26 may be considered to divide more or less into a thoracic region 27 above and an abdominal region 28 therebelow. A waist region 30 may separate the thoracic region 27 from the abdominal region 28. However, may actually be somewhat coincident with the abdominal region 28. Typically, a waist region 30 lies above the hip bone of a user.

In that regard, the hip region may include that region from about the top of the hip bone down to about the beginning of a thigh. Thus, the thigh region 34 begins at some location below the hip of a user, and extends to about the knee region 36 near a knee 42*c* of a user.

Similarly, a calf region 38 begins somewhere below the knee 36, and includes the large calf 42*d* muscle area, down to some location above an ankle region 39. The ankle region 39 extends between a calf region 38 and a foot.

Within each of these regions 22, 24, 25, 26, 27, 28, 30, 32, 34, 36, 38, 39, exist various regions of relief 40 or relief regions 40 and protrusion regions 42. A relief region 40 may be thought of as a region 40 that is adjacent to or somewhat protected by a protrusion region 42 in the vicinity. It may be selected to be inboard, outboard, front, or back of any bodily member, such as a thigh, arm, ankle, and so forth.

For example, a relief region 40*a* in the shoulder region 25 forms something of a depression 40*a* between a shoulder and the pectoral muscles that tend to protrude therebeyond. Thus, a relief region 40*a* provides something of a depression or a region that is protected against bumping, jostling, impact, and the like by adjacent protrusions or protrusion regions.

Similarly, a relief region 40*b* may be referred to as a sternum region 40*b*, and typically operates as a depression below the pectoral region of a user. Similarly, a region 40*c* may be protected by an arm of a user and the pectoral muscles, rib cage, and so forth.

A region 40*d* referred to here as a rib region 40*d* typically is protected by an arm outboard therefrom. It may be represented as a depression associated with a waist region 30 or a comparatively narrower part of the thoracic region 27.

A hip region 40*e*, 40*f* is that region forward of or behind a hip bone of a user. It is protected thereby. Because hands and arms will typically be outboard thereof, and the hip bones likewise, a flat 40*e*, 40*f*, 40*k* or depression 40*e*, 40*f*, 40*k* may exist wherein a pocket 20 may be located. Thus, one will see that the optional pockets, locations 20*a*, 20*b*, 20*c*, 20*d*, 20*e*, 20*f*, 20*k* correspond to a shoulder pocket 20*a*, sternum pocket 20*b*, pectoral pocket 20*c*, rib pocket 20*d*, hip pocket 20*e*, or hip pocket 20*f*, 20*k*. Each of these pockets 20 may be positioned in a relief region 40 appropriate for where they are, without inconvenience, interference, or the like for a wearer.

Similarly, a thigh pocket 20*g* may be located in a relief region 40*g* near the lower end of the thigh, and above a knee region 36. Specifically, a knee 42*c* represents a protrusion. In both forward-to-backward dimensions and side-to-side dimensions, a knee 42*c* represents a protrusion region 42*c*. Accordingly, immediately thereabove, a narrowing portion 40*g* of a thigh region 34 (relief region 40*g*) may receive a pocket 20*g* protected by the bulk of the muscles in the thigh region 34 and the bulk of the size of the knee 42*c*, as protrusion regions 42*c*, 42*g*.

In yet another embodiment, a pocket 20*h* may be placed between a knee region 36, or a knee 42*c*, and the bulk muscle or calf 42*d* of the calf region 38. Thus, for example, the bulk of the calf 42*d* muscle and the bulk of the knee 42*c* may provide a relief region 40*h* suitable for receiving a pocket 20*h*.

Similarly, an ankle pocket 20*g* may be placed in a relief region 40*j* between a foot of a user and the calf region 38. Thus, the calf 42*d* operates as a protrusion 42*d* protecting the ankle relief region 40*j*, and thus providing the location 40*j* for the ankle pocket 20*g*.

The various articles of clothing 10*a*, 10*b* or innerwear 10*a*, 10*b*, may include a rather open expanse 44 sewn together at various locations or closed off at edges by seams 46. Thus, any border 48 or edge 48 may be closed with a seam 46. Similarly, the shape of a top article 10*a* or bottom article 10*b* may be determined and controlled by the shape of the open expanses 44, and the locations of seams 46 securing them together.

Figure 6:
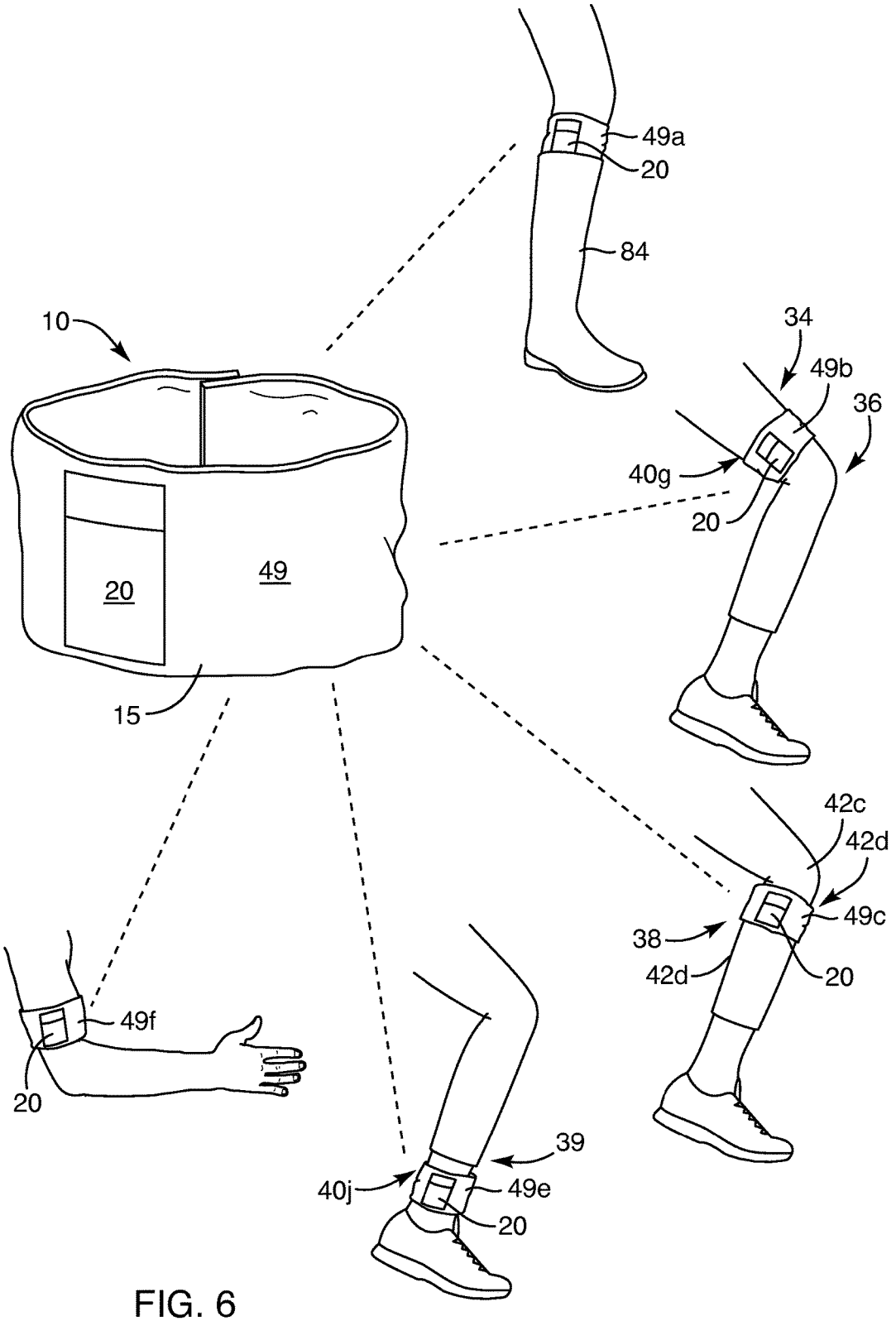
FIG. 6 is an exploded view illustrating various locations on a body of a user, where a band or cuff (e.g., garter) may secure a pocket in accordance with invention thereto.
Figure 7A:
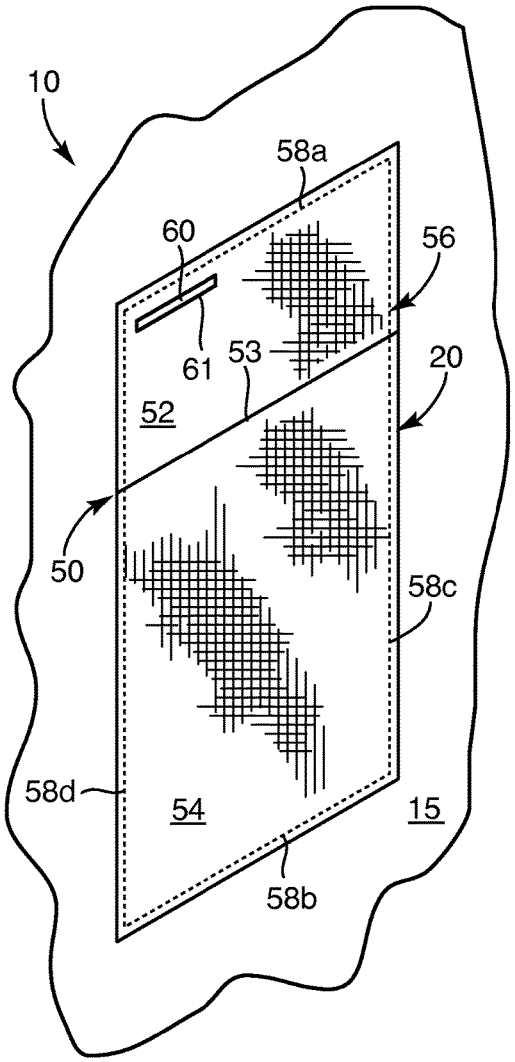
FIG. 7A is a perspective view of one embodiment of a pocket in accordance with invention.
Figure 7B:
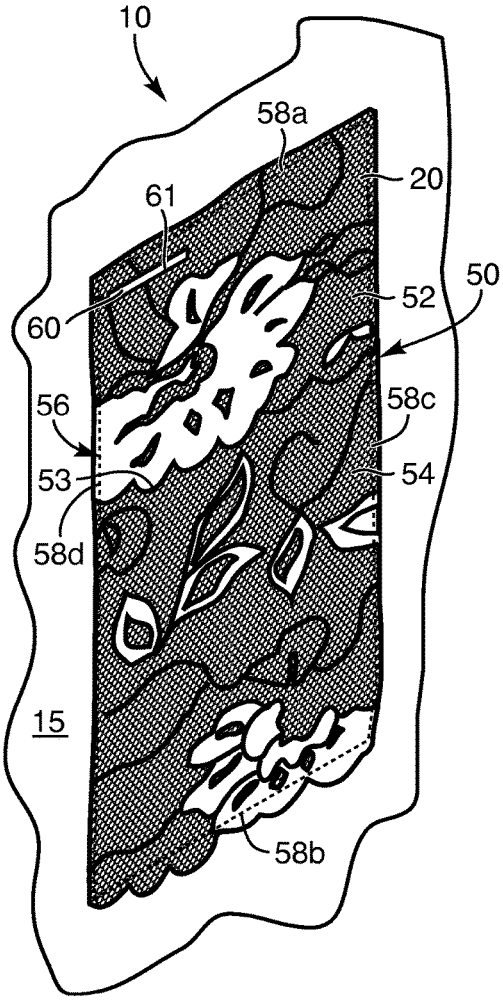
FIG. 7B is an alternative embodiment of a lace pocket in accordance with invention on the fabric of an article of clothing as in FIGS. 1 through 6.

Referring to FIG. 6, while continuing to refer generally to FIGS. 1 through 13, a cuff 49 or band 49 may form a particular stretching, elastomeric article 10 or article of innerwear 10. The cuff 49 may include a pocket 20 oriented in any suitable direction for appropriate wear. Accordingly, in the figure, beginning at the top and moving clockwise, a cuff 49 may be placed in the top of a boot. Next, a cuff 49 may be worn in the lower area of a thigh region 34 above a knee region 36.

Similarly, in the calf region 38 a cuff 49 may be worn above the bulk of the calf 42*d* itself, and below the knee 42*c* in the available relief region 42*d*. Similarly, the next location shows an ankle region 39 in which an ankle relief region 40*j* receives a cuff 49 containing and supporting a pocket 20. Finally, in yet another alternative embodiment, a cuff 49 in the next configuration may fit between an elbow and a bicep (or between bicep and shoulder) on an arm of a user, thereby securing a pocket 20 thereat.

Still referring to FIG. 6, while continuing to refer generally to FIGS. 1 through 13, the cuff 49 or band 49 will typically rely on a certain degree of friction due to an elastomeric character. In certain embodiments, a cuff 49 may be a closed loop of material. In other embodiments, it may be openable and closed selectively with a fastener. For example, a zipper, snap, buttons, hook-and-loop fastener, or the like may be used to fit the band 49 snuggly around an appendage.

In another example, when the cuff 49 is secured in the top of a boot, a portion of the cuff 49 may extend, exposing part of the pocket 20 outside the boot for access. Similarly, a band 49 or cuff 49 in an ankle region 39 may tuck inside a low boot or short boot, or be placed just above a shoe or short boot.

Thus, a band 49 or cuff 49 may rely on another article of clothing, such as a boot, or shoe, to maintain its position. Likewise, it may rely on the change in cross section of a knee region 36 or the calf muscle in the calf region 38 to restrict it from sliding down with motion and gravity influences. In other embodiments, wherein the pocket 20 is secured to another innerwear article 10 then the supporting forces are provided by the system 10 itself, and need not be directly related to frictional forces, or changes in section, and so forth.

Referring to FIGS. 7 through 10F, while continuing to refer generally to FIGS. 1 through 13, a pocket 20 in accordance with the invention may actually include the system 10 including a particular article 10 of clothing that may be a top article 10*a*, bottom article 10*b*, or the band 49. The article 10 is formed of, and represents, a fabric 15 or layer 15 to which a pocket 20 is secured.

A pocket 20 may be made of a cover 52 overlapping a containment 54. Both may be of the same or different fabrics 15. "Stretch" fabrics 15 seem to serve best. They are typically "knit" fabrics. Cross-woven fabrics work, but require slack in the article 10 in not elastomeric.

The cover 52 or top flap 52 is actually not a flap at all, but is a second conventional-like pocket 52 inverted. For example, the lower edge 53 of the cover 52 overlaps the top edge 54 of the main portion 54 or containment 54. Thus, the cover 52 represents a "pocket" in a conventional sense that overlaps the main portion 54 of the pocket 20 or containment 54 of the pocket 20. Thus, the overlap region, between the lower edge 53 or top lip 53 on a mouth region 50 or mouth 50, overlapping the top edge 55 or bottom lip 55 provides securement of any content within the pocket 20.

Seams 58 are best double seams 58. The mouth seam portion 56 extends, and may be sewn double that or more in order to secure against all the forces that will be applied repeatedly to open the mouth 50. The mouth seam portion 56 may simply be an extension of the main seams 58 of the pocket 20.

For example, a top seam 58*a* secures a portion (e.g., top edge) of the cover 52. A bottom seam 58*b* secures a portion (e.g., lower edge) of the containment 54 along its width 57*a*. Meanwhile, the left side seam 58*c* and the right side seam 58*d* may extend along the entire height 57*b* (length 57*b*) of the pocket 20. These 58*c*, 58*d* secure both the cover 52, and the containment 54. For durability, additional seaming 58 may be placed to secure the mouth seam portion 56 by resisting pulling forces when opened.

In other embodiments, the mouth seam portion 56, may simply be those portions of the side seams 58*c*, 58*d* that extend along the mouth region 50 between the lower edge 53 of the cover 52 and the top edge 55 of the containment 54.

One will also note that the apertures 60 may be single or multiple with respect to a particular pocket 20. For example, in one embodiment, the aperture 60*a* may be placed through the material forming the cover 52. A suitable reinforcement 61 such as a grommet 61, a satin-stitch seam 61, a button hole seam 61, or the like may be used to reinforce the aperture 60. Continuing use and wear of objects moving through the aperture 60 may be protected against by the reinforcement 61.

The seams 58 may be made by thread. In other embodiments, some other fastener 58 may include a bonding agent, such as a heat-activated glue or the like. Fusible fabrics including "iron-on" fabrics may bond or fuse. Thermoplastics may be used to form thermally activated glues. In other embodiments, a fabric formed of a synthetic material may be used to bond to the underlying clothing article 10.

A reinforcement patch 63*a* may optionally be added as a backing material to the fabric material 15 of the pocket 20, or to the material of the fabric 15 of the clothing article 10 to which the pocket 20 is attached.

Figure 8:
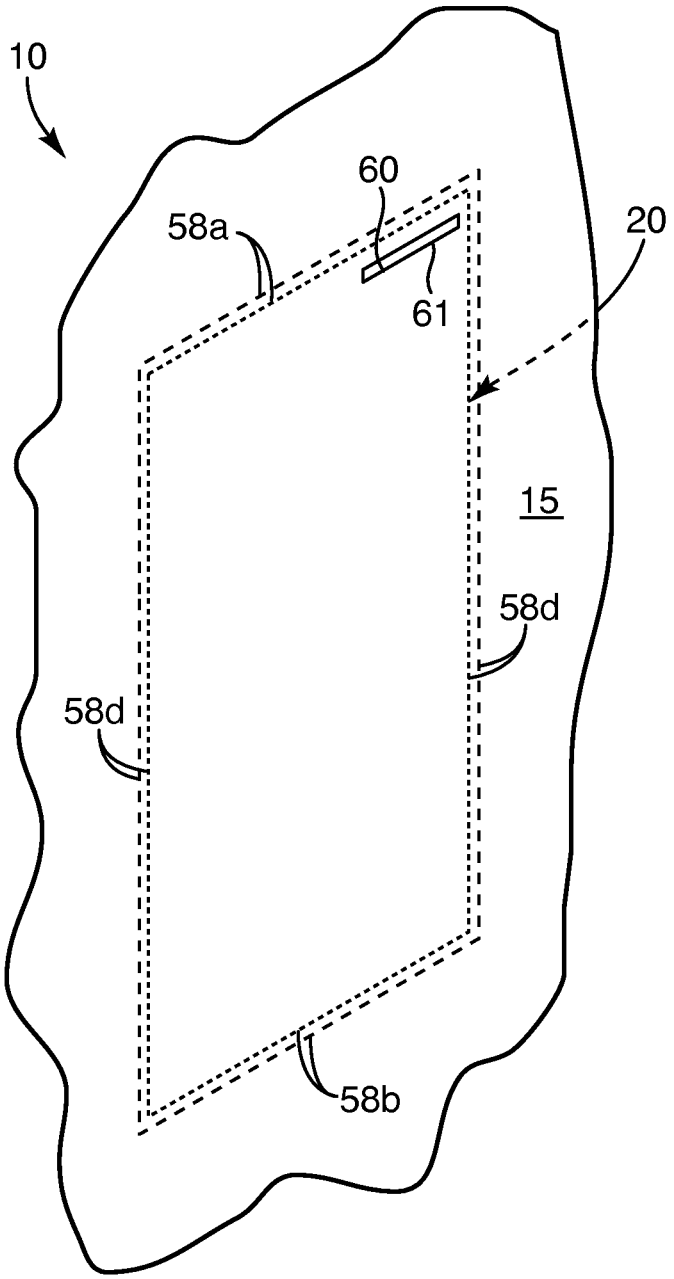
FIG. 8 is a rear perspective view of one embodiment of a pocket having an opening providing access to the interior of an article of clothing.
Figure 9B:
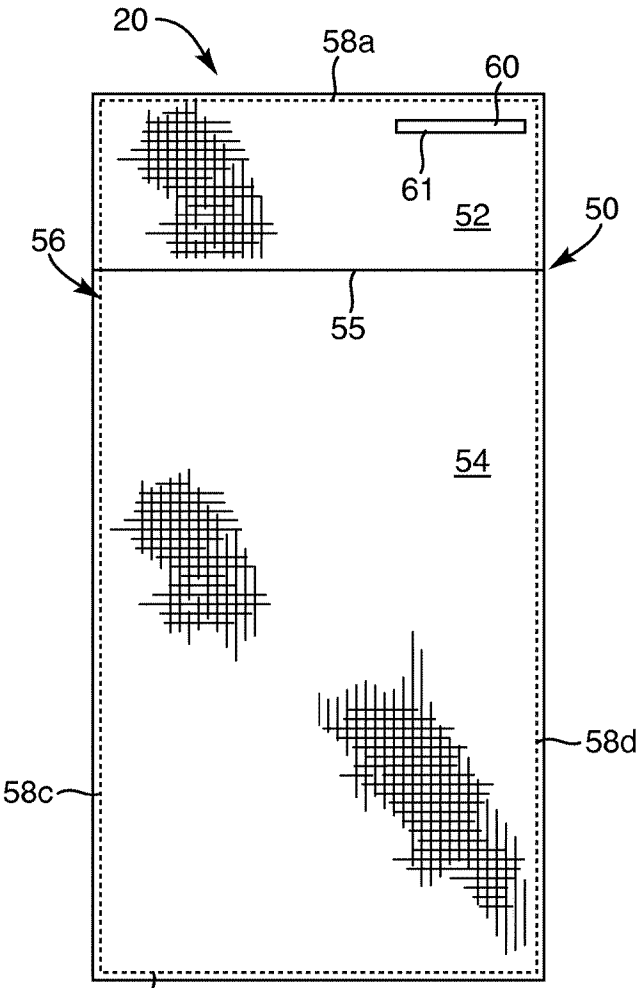
FIG. 9B is a rear elevation view thereof.
Figure 9A:
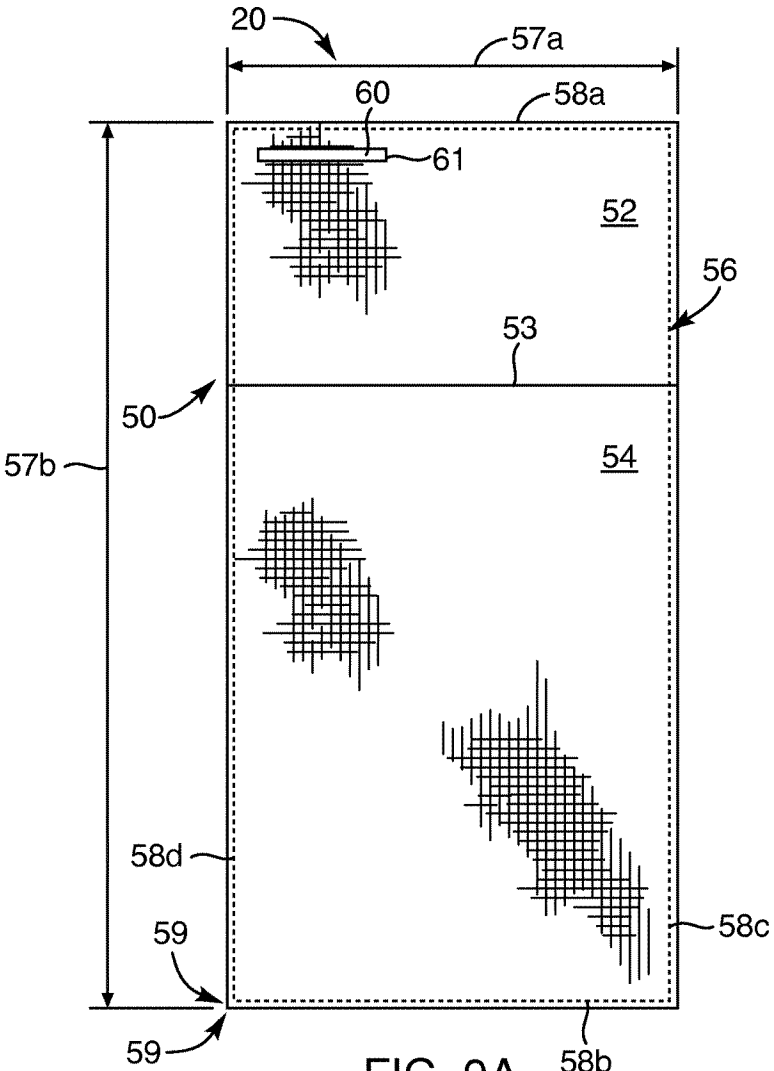
FIG. 9A is a front elevation view of one embodiment of a pocket, in accordance with invention, suitable for holding a device or object such as a mobile phone or audio player.
Figure 9C:
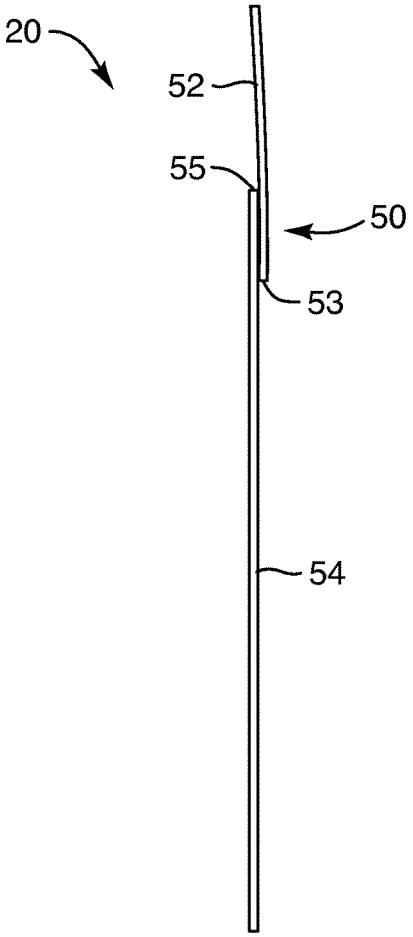
FIG. 9C is a right side elevation view thereof.
Figure 9D:
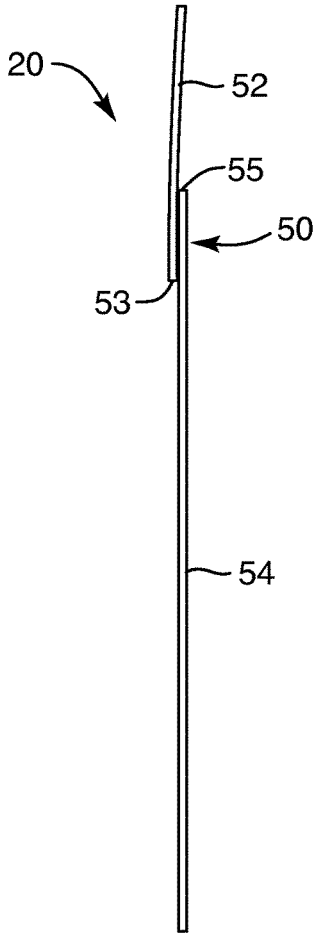
FIG. 9D is a left side elevation view thereof.
Figure 9E:
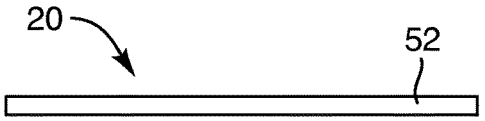
FIG. 9E is a top plan view thereof.
Figure 9F:
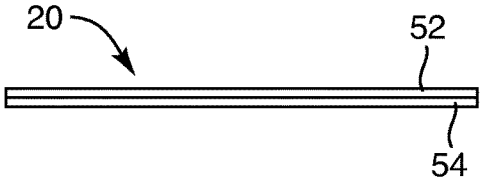
FIG. 9F is a bottom plan view thereof.
Figure 10A:
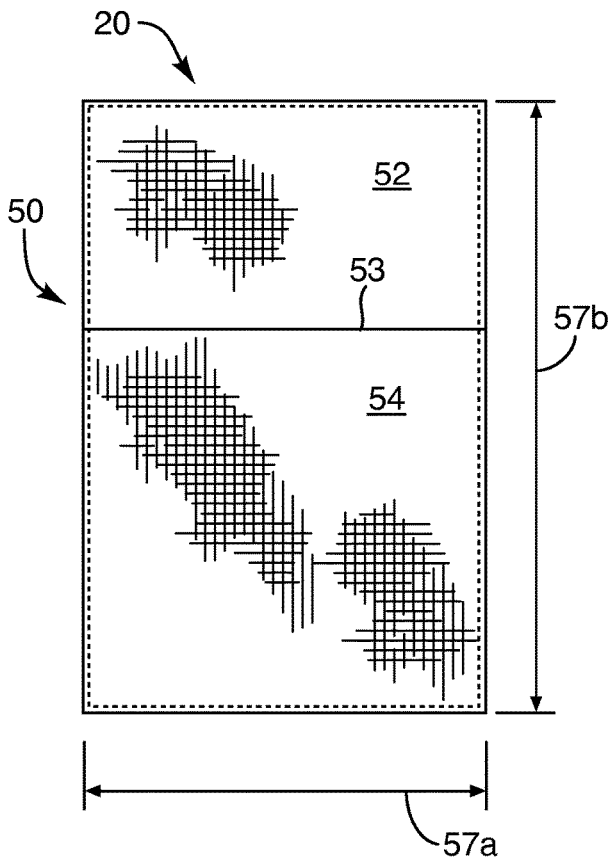
FIG. 10A is a front elevation view of an alternative embodiment of a pocket, in accordance with invention, such as may secure an insulin pump or other medical device.
Figure 10B:
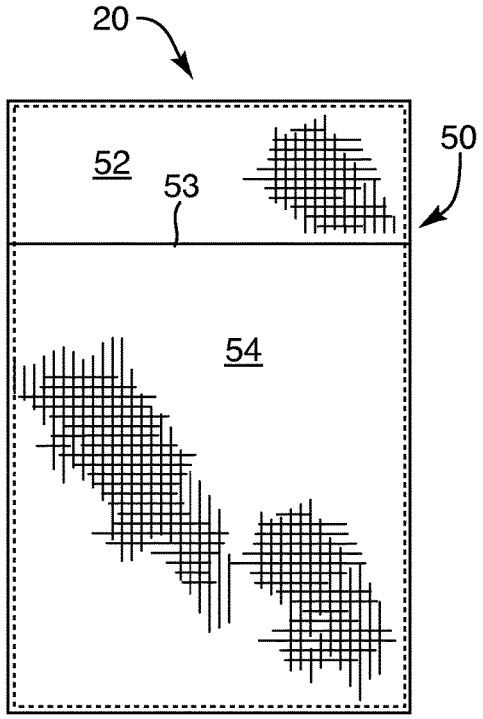
FIG. 10B is a rear elevation view thereof, illustrating the pocket only, and not the base fabric of the article of clothing on which it is worn.
Figure 10C:
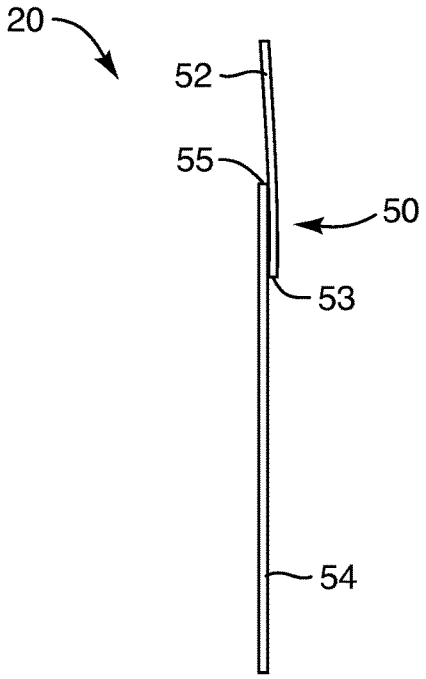
FIG. 10C is a right side elevation view thereof.
Figure 10D:
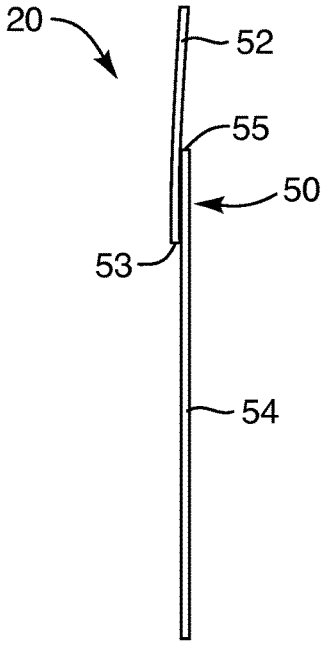
FIG. 10D is a left side elevation view thereof.
Figure 10E:
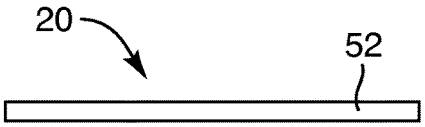
FIG. 10E is a top plan view thereof.
Figure 10F:
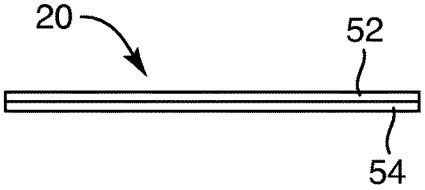
FIG. 10F is a bottom plan view thereof.
Figures 11A, 11B, 11C, 11D, 11E:
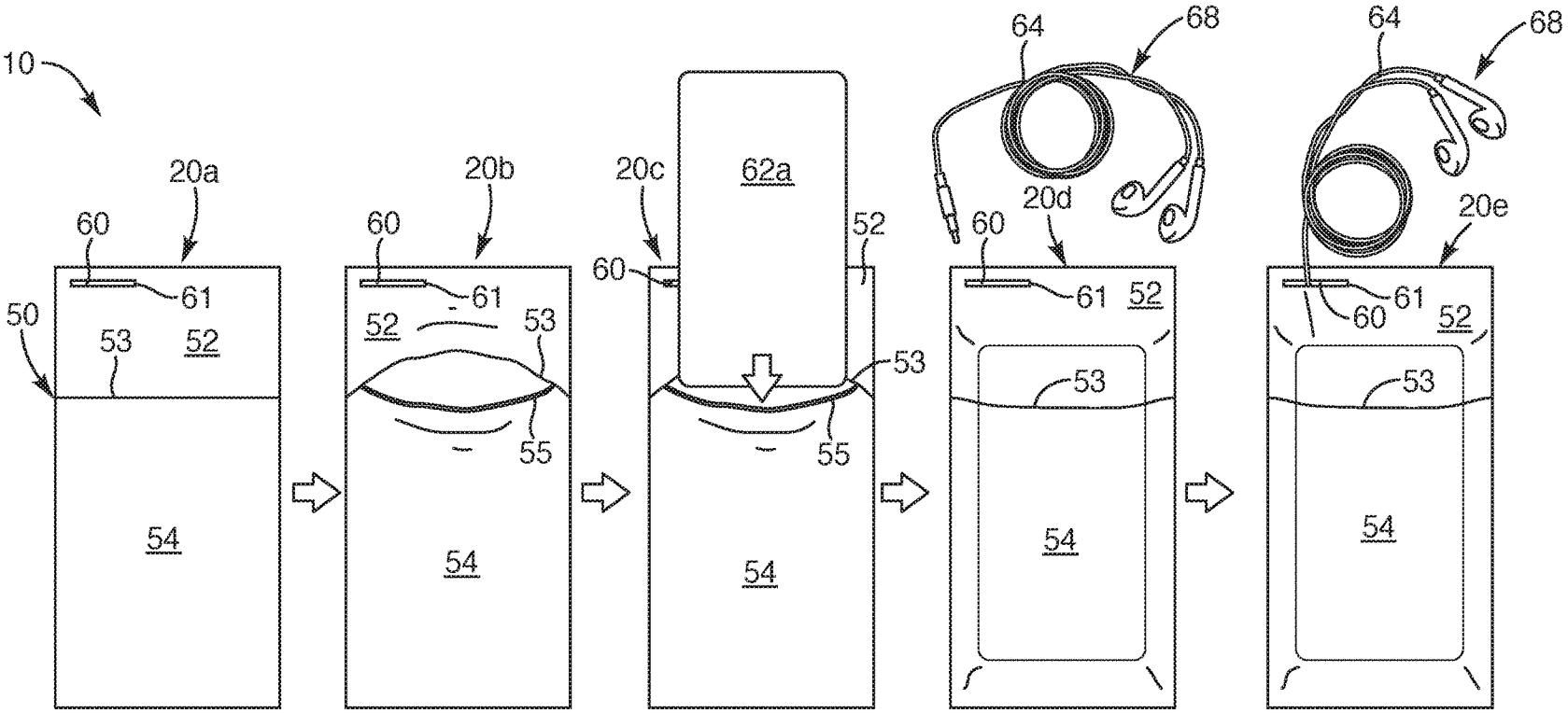
FIGS. 11A through 11E show a front elevation view of a pocket in accordance with invention undergoing a process of opening, filling, and closing, including receiving an object and a line connected through a port to that object.

Referring to FIG. 8, while continuing to refer generally to FIGS. 1 through 13, in the containment of an insulin pump 62*b* as the device 62 to be held within a pocket 20, an additional loop 63*b* may be added. It may be secured by or may operate as a reinforcement 63*a* as well. However, typically, the accessories 63*a*, 63*b* or features 63*a*, 63*b* may be used for reinforcing the aperture 60*b*, and stabilizing the apertures 60 against the line 64 that extends from the pocket 20.

Referring to FIGS. 9A through 9F, in one embodiment of a pocket 20 in accordance with the invention, the pocket 20 may be sized to fit an object or device such as a mobile phone, electronic tablet, audio player, pocket book, debit card, tool, weapon, or the like. The size and shape of the pocket 20 may accordingly provide for a mouth region 50. The mouth 50 will open adequately to receive the object 62 and automatically close to secure to it within the pocket 20. Again, FIGS. 9A through 9F simply illustrate the details of the pocket 20, and not the backing fabric 15 or article 10 that constitutes the principal garment 10 of the innerwear system 10.

In that regard, the system 10 may involve an article 10 visible as outerwear as well. However, the benefit of concealment is improved if the article 10 is innerwear, such as underwear 10, base layers 10 of active wear 10 for sporting activities, or the like. Nevertheless, in some sports activities, the outerwear used includes singlets, tank tops, t-shirts, capris, tights, leggings, form fitting trousers or pants, shorts, and so forth. Thus, the underlying fabric 15 or article 10 formed of a fabric 15 is removed in FIGS. 9A through 9F, and FIGS. 10A through 10F in order to simply illustrate the pocket 20 itself.

Referring to FIGS. 10A through 10F, in certain embodiments, the cover 52 of a pocket 20 need not contain an aperture 60. In the illustrated embodiment, the pocket 20 of FIGS. 10A through 10F applies to various situations. In one embodiment, a line 64 may be passed out through the mouth region 50, by passing over the top edge 55 of the containment 54, and under the lower edge 53 of the cover 52 in order to pass outside the pocket 20.

However, in one currently contemplated embodiment, the pocket 20 relies on an aperture 60*b* formed in the underlying fabric 15 of the article 10 to which the pocket 20 attaches. For example, an insulin pump system 62*b* may pass a line 64 through an aperture 60*b* in the fabric 15, toward the interior of the article 10, between the body of a user, and the article 10.

Also, for example, a comparatively long line 64 delivering insulin to an infusion site may pass through the base material 15. It may be collected or gathered in a loop 63*b* for that purpose. The residual length of the line 64 may then proceed on to the infusion site. To that end, a backer 63*a* or reinforcement 63*a* may be sewn, ironed, or otherwise bonded to the fabric 15 to extend about the aperture 60*b*.

A similar patch 63*a* or reinforcement 63*a* may be placed under the loop 63*b* to stabilize that elastic loop 63*b* with respect to the fabric 15 of the article 10 by distributing forces, the reinforcement 63*a* resists tearing, separation, or excessive distortion.

Referring to FIGS. 11A through 11E, use of a system 10 in accordance with the invention may involve the use of a pocket 20 illustrated by the configurations 20*a* through 20*e* of FIGS. 11A through 11E. Digits (fingers, thumb, both) of a user may be inserted under the cover 52 and over the containment 54. One may hook the edge 53 to draw open the mouth 50*a* into an open configuration. Thereafter, in the configuration 20*c*, the pocket 20*c*, receives an object 62 or device 62 placed into the open mouth 50*a*.

Once the object 62 or device 62 has been placed inside the containment 54, the edge 53 cover 52 may be drawn over the top of the object 62, if the object 62 is taller than the edge 55. Otherwise, release will let the cover 52 return automatically, thus arriving at the closed and filled configuration of the pocket 20*d*.

Ultimately, in the pocket 20*d* or the configuration of the pocket 20*d*, a line 64 may be placed through the aperture 60*a*. This may be done by placing a plug through the aperture 60*a* into a jack in the object 62. In this instance, the illustrated embodiment of the line 64 connects to earbuds 68, such as those used in listening to an audio player, mobile phone, or the like.

Figures 12A, 12B, 12C, 12D, 12E:
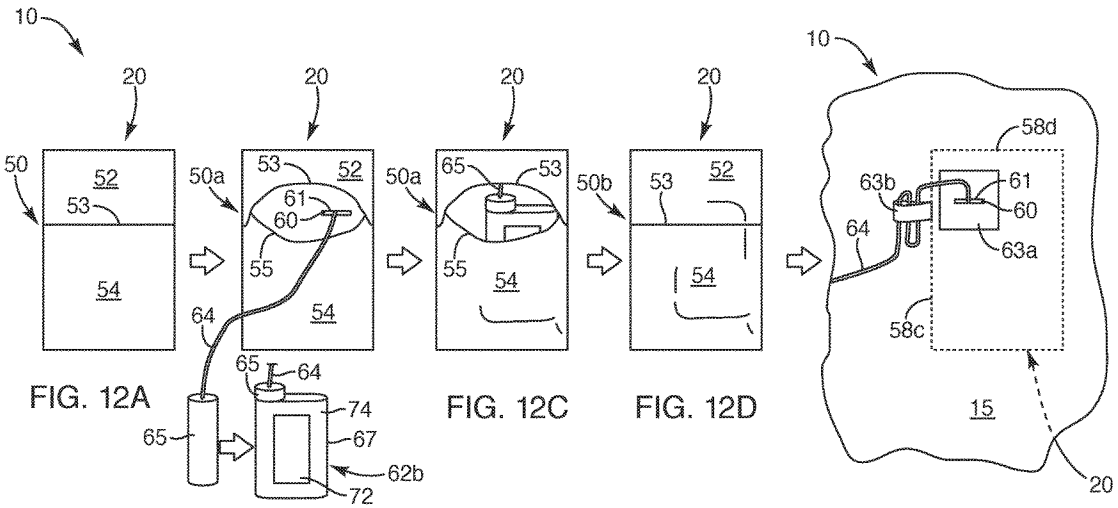
FIGS. 12A through 12D are front elevation views and FIG. 12E is a rear elevation view, in sequence, of a pocket undergoing a process for opening and filling a pocket in accordance with invention with an object, for example, an insulin pump, also including threading a line from the pump through an aperture into the interior of the article of clothing.

Referring to FIG. 12, a pocket 20 may be configured as an insulin pump pocket 20*a* in a closed configuration 20*a*. It may be opened by drawing apart the lower edge 53 of the cover 52 away from the upper edge 55 of the containment 54. Thus, the pocket 20*b* is effectively a pocket 20 in the configuration of being opened at the mouth 50.

In the configuration 20*c* of the pocket 20 the insertion configuration 20*c* includes the pump system 62*b* being inserted into the mouth 50 to be secured within the containment 54. Again, once the device 62, in this case a pump 62*b* system, is securely within the containment 54, the cover 52 may be drawn down (automatically or by finger) over the containment 54. This results in the configuration 20*d* of the pocket 20.

From the back side of the article 10 to which the pocket 20 pertains, as illustrated, the reinforcement patch 63*a* may surround the aperture 60. Meanwhile, an elastic loop 63*b* may secure to the article 10 of clothing. It may have its own backing 63*a* therebetween. Excess line 64 for delivering insulin to an infusion site from the pump system 62*b* may be gathered and secured by the loop 63*b*.

One will note that the cover 52 may constitute another, inverted, conventional pocket, where the word term "pocket" here now means a conventional pocket 20. It inverts over and opposite the containment 54 or main compartment 54. Two conventional pockets inverted may render both inoperable. However, a conventional pocket as a top cover 52, provides securement against inverted users, active motion, jostling, bouncing, and the like of objects 62 or devices 62 within the pocket 20. Virtually any motion short of ripping fabric 15 will not result in release of the device 62, under any circumstance.

Figure 13:
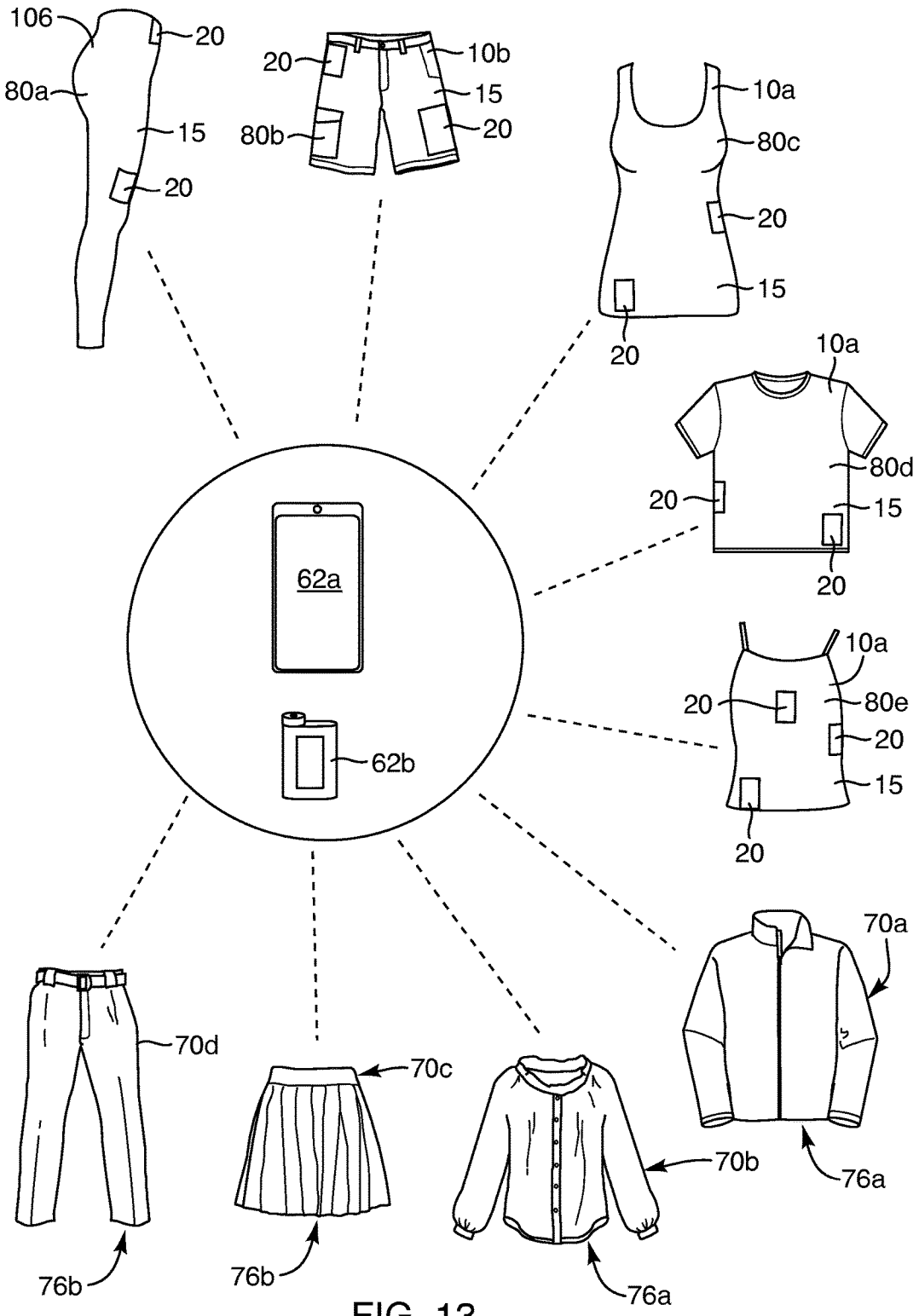
FIG. 13 is an exploded view of various alternative embodiments of innerwear and outerwear, the former provided with various embodiments of pockets in accordance with invention, and the latter illustrating examples of outerwear that may be worn over innerwear, thus hiding a pocket in accordance with invention.

Referring to FIG. 13, while to continue generally to FIGS. 1 through 13, various types of innerwear are illustrated. For example, moving clockwise from the top of the figure a pair of tights 80*a* or leggings 80*a*, a pair of shorts 80*b*, and the like represent innerwear bottom portions 10*b*. Meanwhile, the tank top 80*c*, t-shirt 80*d*, and camisole 80*e* represent innerwear tops 10*a*. The pocket 20 in accordance with the invention may be worn on any of these articles 10 in an appropriate location, at least one of which is included in each.

Nevertheless, in such embodiments, if the particular article 10 is worn as the outermost layer, the pocket 20 will be visible, whether that is desired or not. When the pocket 20 should be hidden, another layer 76, outerwear 76, may cover the innerwear 10. For example, a conventional, loosely fitted jacket 70*a*, blouse 70*b*, skirt 70*c*, or trouser 70*d* may be worn over any corresponding article of innerwear 10 as a top outerwear piece 76*a* or a bottom outerwear piece 76*b*. Thus, any of the objects 62, devices 62, or others 62 may be carried in a pocket 20 suitably configured, on any particular article 10 in a system 10 in accordance with the invention.

As one can see, a pocket 20 in a system 10 in accordance with the invention ensures that items cannot fall out. A pocket 20 may be hidden or strategically placed on an item of innerwear 10, which may include athletic clothing 10, dance wear 10, yoga wear 10, exercise wear 10, and similar articles 10. Likewise, underwear 10 (e.g., briefs, bras, camisoles, under shirts, tights, etc.) and the like may also receive pockets 20 in accordance with the invention.

Typically, the materials 15 or fabrics 15 of which the pockets 20 and articles of clothing 10 are fabricated include elastomeric (elastic) fibers, are knit, or both, so they are typically "stretchy." Lace, netting, and other deformable, discontinuous-surface fabrics 15 may also be used. See-through fabrics may permit operation of devices through front control panels 72 on their faces 74 without removal from the pocket 20.

For example, SPANDEX® brand elastomeric fabric is a fabric that includes elastomeric fibers as well as conventional fibers such as synthetic materials (nylon, polyester, etc.) natural materials (e.g., cotton, wool, etc.). It serves well for such functions. Similarly, any elastomeric fabric 15 may be suitable for pockets 20. In certain embodiments, the pockets 20 may be formed of lace, netting, latticed materials, loosely woven materials, knit materials, and so forth.

Even without stretch fabrics, a mouth 50 of a pocket 20 may be opened by gathering and pulling on the underlying fabric 15 of the article 10 of clothing. However, it has been found suitable to use a stretch fabric 15 for the article of clothing 10 as well as the pocket 20.

Such a system 20 having a containment portion 54 and a cover portion 52 is effectively two pockets, in a conventional sense. That is, each is seamed 58 on three sides. The two components 52, 54 share an overlapping mouth area 50. Such a system 10 is suitable for holding a cell phone 62*a*, debit card 62*a*, cigarettes 62*a*, insulin pump 62*a*, other objects 62, or the like. Larger items such as smart phones, electronic notepads, small tablets, paperback books, flasks, handguns, and the like may be held in larger embodiments of the pockets 20.

Whether turned upside down, jarred, or exposed to rapid movements otherwise, even a heavy mobile phone cannot be jarred out of the pocket 20. The cover 52 being sewn 58 on three sides and having a shared mouth seam region 56 on the sides 58*c*, 58*d* may effect closure automatically with no intervening actions by the hand of a user. Simply put, the fabric 15 of the article of clothing 10 draws the mouth 50 closed automatically due to the form-fitting nature of the article of clothing 10.

The materials may include radiation-frequency-blocking fabric. Radio frequencies in the range of from about ten megahertz up through about thirty gigahertz may be blocked by available fabrics 15. Each of the fabrics 15 in an article of clothing 10, a pocket 20, or both may be lined with or formed of a radiation-frequency-blocking fabric of this type. For example, whether bonded together as a layered or laminated fabric 15, or sewn on after-the-fact with the pocket 20, such a liner may line the article 10, the pocket 20, or both against the escape of radiation within the selected frequency range.

Stretch laces have been found suitable. The band 49 (strap 49, cuff 49, garter 49, or the like) provides a method to implement a pocket 20 in the absence of another, larger, covering article 10. Tank tops 80*c*, leggings 80*a*, biking shorts 80*b*, boots 84, and the like all receive and carry well the pockets 20 in accordance with the invention.

It has been found that double stitching the seams 58*a*, 58*b*, 58*c*, and 58*d* seems to serve best. It is not required. In fact, in some embodiments, a zig zag stitch or the like has been found suitable. Similarly, as can be seen, the lace edge 53 in FIG. 7B forms the lip 53 or lower edge 53 of the cover 52. Thus, the decorative element completely obscures any sewing or the presence of the mouth region 50.

Typically, the materials may be from about three to about four inches (7.5 to 10 cm) wide, and from about five to about seven inches (12.5 to 18 cm) long. For example, the width 57*a* and the length 57*b* of a pocket 20 may be sized for the specific device 62. For smart phones 62*a* and the like, a pocket 20 on the order of three and a half inches (8 cm) by about six inches (15 cm) has been found suitable for cell phone use. On the other hand, it has been found that a width 57*a* of about three inches (7.5 cm) wide with a length 57*b* of about four to five and a half inches (10 to 14 cm) is functional for an insulin pump 62*b*. In most insulin pump systems 62*b*, an overall height of about four inches (ten centimeters) has been found suitable.

Typically, an insulin pocket 20, such as a hip pocket 20*e*, 20*f* may typically be positioned about three inches (7.5 cm) above a bottom edge of top 10*a*. This should be just below and in board of the top of the hip bone. Typically in rib placement, for an adult, a height of about ten inches (25 cm) above the bottom of a tank top 80*c* or the like is adequate.

In general, for a child, a target dimension or distance between the bottom seam 58*b* of a pocket 20 and the bottom edge of a top article 10*a* may be about three inches (7.5 cm). For adults, a distance of about three inches (7.5 cm) also serves for an insulin pocket 20 as a hip pocket 20*e*, 20*f*. Rib pockets 20*d*, 20*k* on the other hand at ten inches (25 cm) above the bottom edge of the article 10*a* may be suitable for women with about twelve inches (30 cm) suitable for men, depending, of course, on height and build for each.

Location of a pocket 20 is a matter of convenience and comfort. Typically, relief locations 40 are no-hit spots 40 where a contained device 62 is unlikely to be struck, damaged, moved, or to transfer impact to a user. Typically, such relief regions 40 cover soft tissues of the body and are obscured or hidden within the body's outer profile. Thus, they may be placed in any of the locations illustrated in FIGS. 1 through 5 or others.

However, the hip locations 40*e*, 40*f* and the rib locations 20*d*, 20*k* may serve best as locations 40 for insulin pockets 20. For some adults, a sternum pocket 20*b* may also serve as a suitable insulin pump pocket 20. One reason for this is that infusion sites are typically around the abdomen, the belly, where tissues are thicker, less mobile, with comparatively large expanses available. This avoids interference from bones, thin layers of tissue over joints, and the like.

Whether worn on snug outer clothing, other types of wear such as innerwear, underwear, briefs, or the like, the controller 67 of devices 62 may be accessible for control through the pocket 20 if they have a control screen 66 or control button 72 on a front face 74 thereof. For example, an insulin pump system 62*a* may include a cylinder 65 or reservoir 65 integrated therewith or in nearby proximity. In such an embodiment, a screen 66 or control panel 66 may sit on a front face 74 where it is viewable through netting or lace forming the containment portion 54 of a pocket 20. Thus, it has been found that the control panel 66 may be operated by a user without removing the device 62 from within the pocket 20.

Of course, the specific locations of various pockets 20 on various articles of clothing 10 may vary depending on the size of a user. For example, a size two through four toddler may wear a top 10*a* about thirteen inches long (33 cm) by about six inches wide (15 cm). Meanwhile, shirts size five through eight in children's sizes may be about fifteen inches long (38 cm) by about eight inches wide (20 cm). Shirts in sizes nine through ten are about seventeen inches long (43 cm) by about ten inches wide (24 cm).

Larger innerwear top 10*a* sizes for adults, particularly women, may range from about twelve inches across (30 cm) to about fifteen inches long (38 cm). Heights corresponding thereto range from about twenty seven inches (68 cm) to about thirty inches (76 cm).

For men, innerwear shirts 10*a* may range from about fifteen inches (38 cm) to about eighteen inches (45 cm). Corresponding heights range from about thirty inches (76 cm) to about thirty three inches (83 cm).

Typically, a button hole of about seven millimeters length is adequate for an aperture 60. Meanwhile, the seams 61 or other reinforcements 61 therearound may be a satin stitch button hole seam 60 as is known in the art, a grommet 61 or the like. The button hole 60 may range from about seven millimeters to about twenty millimeters in diameter. The size of the aperture 60 may actually be a matter of personal choice.

The present invention may be embodied in other specific forms without departing from its purposes, functions, structures, or operational characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A method of forming a pocket on an article of clothing, the method comprising:

providing an article of clothing comprising an expanse of fabric sized, shaped, and stretchable to be configured as form fitting to the shape of the skin of a wearer as innerwear;

providing a containment portion of the pocket having a containment perimeter defined and entirely circumscribed by a top edge and a remaining edge, the top edge being free and the remaining edge being bound to be configured as form fitting directly against the expanse of fabric, rendering the containment portion a first sub pocket having a containment opening, open in a single direction corresponding to the top edge;

providing a cover portion of the pocket having a cover perimeter defined and entirely circumscribed by a bottom edge and a residual edge, the bottom edge being free and the residual edge bound to be configured as form fitting directly against the expanse of fabric;

providing the containment portion and cover portion form fitted to the expanse of fabric and arranged to be overlapping the top edge and the bottom edge by a distance selected to render the cover portion a second sub pocket, inverted to open only along the bottom edge thereof and completely enclosing the containment opening against passage of an object out of the containment opening;

forming an aperture in at least one of the cover portion or the expanse of fabric thereby providing access by an elongate line to an interior portion of a cavity formed by the pocket between the fabric and at least one of the cover region and the containment region;

placing an electronically controlled device on the expanse of fabric under the cover portion and the containment portion of the article of clothing; and providing a line to conduct a physical material, the line having a first end configured to connect to the electronically controlled device and a second end configured to contact directly the body of the wearer.

2. The method of claim 1, further comprising selecting a relief region as a location for securing the pocket, comprising the containment portion, the cover portion, and a portion of the fabric.

3. The method of claim 2, wherein the relief region is selected to corresponding to a portion of the article of clothing sized and shaped to overlie soft tissue of a user proximate a protrusion corresponding to a bodily member thereof.

4. The method of claim 3, wherein the relief region is positioned proximate one of a shoulder, a sternum, an arm, a rib, a hip, a thigh, a calf, and an ankle.

5. The method of claim 4, wherein at least one of the containment region and the cover region is rectangular in shape.

6. The method of claim 5, wherein the pocket is substantially rectangular in shape.

7. The method of claim 6, wherein the article of clothing is an article of innerwear effectively form fitting about a body of a wearer.

8. The method of claim 7, wherein the aperture defines a perimeter and the method further comprises providing a reinforcement to the aperture by securing to the perimeter at least one of a seam, a grommet, and a backing layer.

9. The method of claim 8, wherein at least one of the fabric, the cover portion, and the containment portion are formed of a cloth containing a knit, elastomeric material.

* * * * *